US005521324A

United States Patent [19]

Dannenberg et al.

[11] Patent Number: 5,521,324

[45] Date of Patent: May 28, 1996

[54] AUTOMATED MUSICAL ACCOMPANIMENT WITH MULTIPLE INPUT SENSORS

[75] Inventors: Roger B. Dannenberg, Pittsburgh; Lorin V. Grubb, Dover, both of Pa.

[73] Assignee: Carnegie Mellon University, Pittsburgh, Pa.

[21] Appl. No.: 277,912

[22] Filed: Jul. 20, 1994

[51] Int. Cl.[6] ..... G10H 1/02; G10H 1/38; G10H 1/40

[52] U.S. Cl. ..... 84/612; 84/613; 84/631; 84/633; 84/DIG. 4

[58] Field of Search ..... 84/609–614, 631, 84/633–638, DIG. 4

[56] References Cited

U.S. PATENT DOCUMENTS 4,745,836 5/1988 Dannenberg .
5,393,927 2/1995 Aoki ..... 84/631

OTHER PUBLICATIONS

Katayose, et al., *Virtual Performer,* ICMC Proceedings, pp. 138–145, 1993, Osaka, Japan.

Dannenberg, et al., *Practical Aspects of a Midi Conducting Program,* Proceedings of the 1991 International Computer Music Conference, pp. 537–540, Computer Music Association, San Francisco.

Inoue, et al., *A Computer Music System For Human Singing,* ICMC Proceedings 1993, pp. 150–153, Tokyo, Japan.

VIVANCE™, *Personal Accompanist,* Coda Music Technology, 1992, Eden Prairie, MN.

*Primary Examiner*—Stanley J. Witkowski
*Attorney, Agent, or Firm*—Kirkpatrick & Lockhart

[57] ABSTRACT

The present invention is directed to an apparatus and method for automating accompaniment to an ensemble's performance. The apparatus is comprised of a plurality of input devices with each input device producing an input signal containing information related to an ensemble's performance. A plurality of tracking devices is provided, with each tracking device being responsive to one of the input signals. Each tracking device produces a position signal indicative of a score position when a match is found between the input signal and the score and a tempo estimate. A first voting device is responsive to each of the position signals for weighting each of the position signals. The weighting may be based on the frequency with which it changes and the proximity of its score position to each of the other score positions represented by each of the other position signals. The same weighting factors are then applied to the tempo estimate associated with that position signal. After the position signals and tempo estimates have been weighted, the voter device calculates a final ensemble score position signal in response to the weighted position signals and a final ensemble tempo based on the weighted tempo estimates. A scheduler is responsive to the final score position and final ensemble tempo for outputting an accompaniment corresponding thereto.

30 Claims, 5 Drawing Sheets

FIG. 6
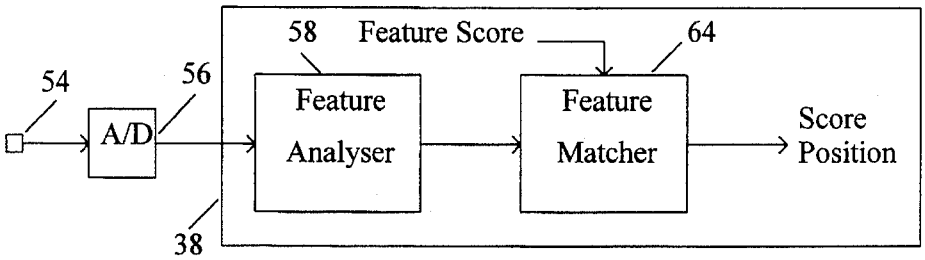
FIG. 7
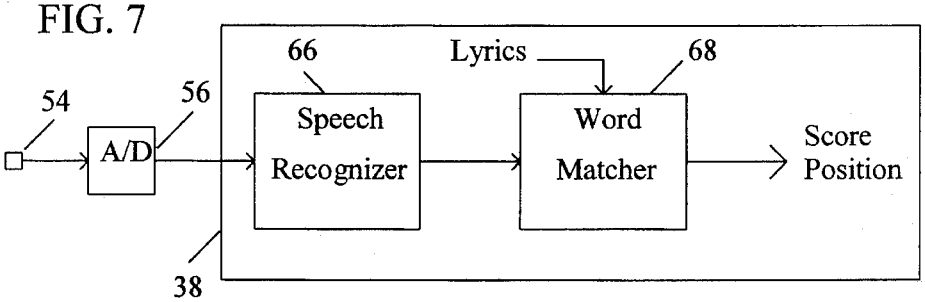
FIG. 8
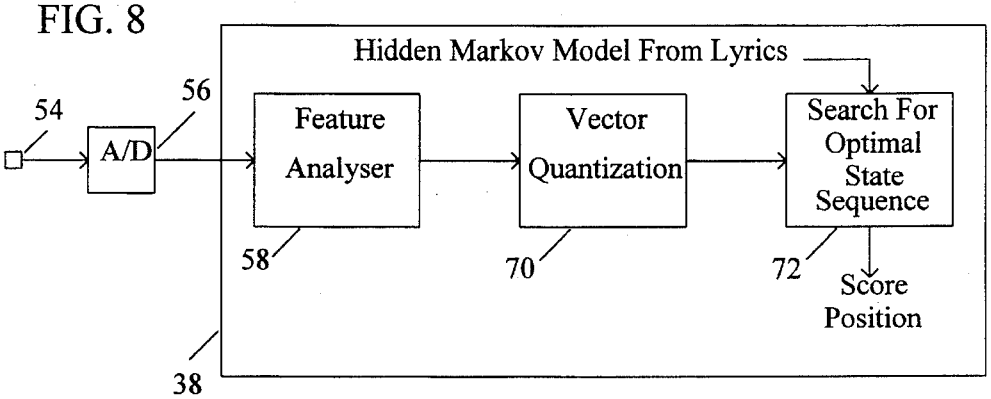
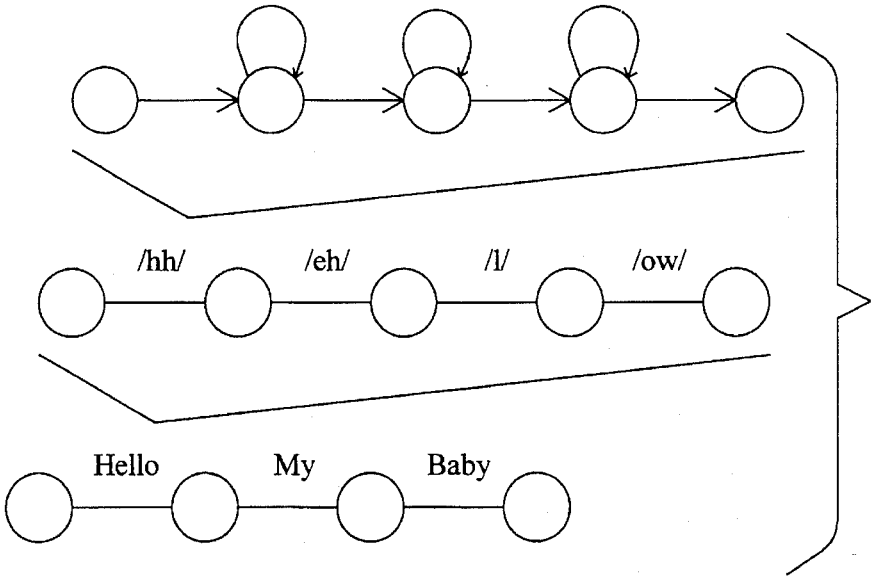
FIG. 9

FIG. 10
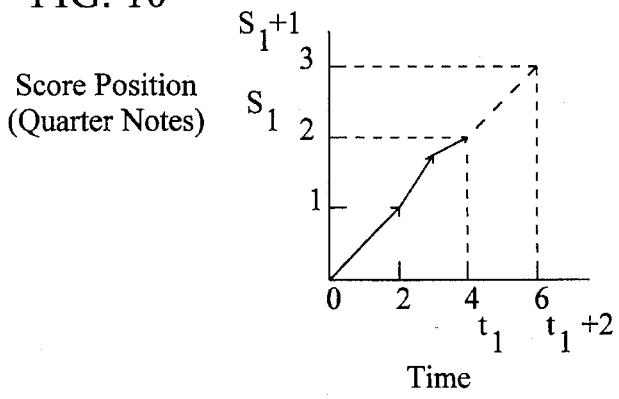
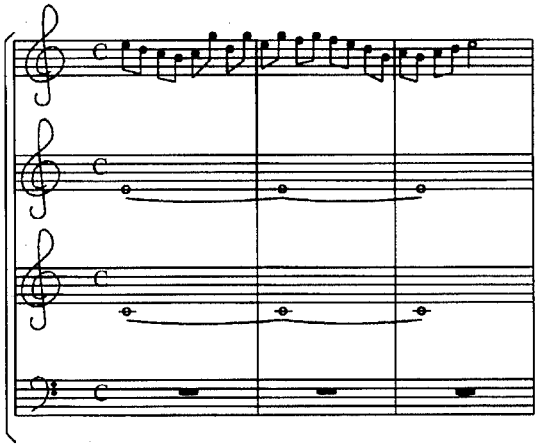
FIG. 11
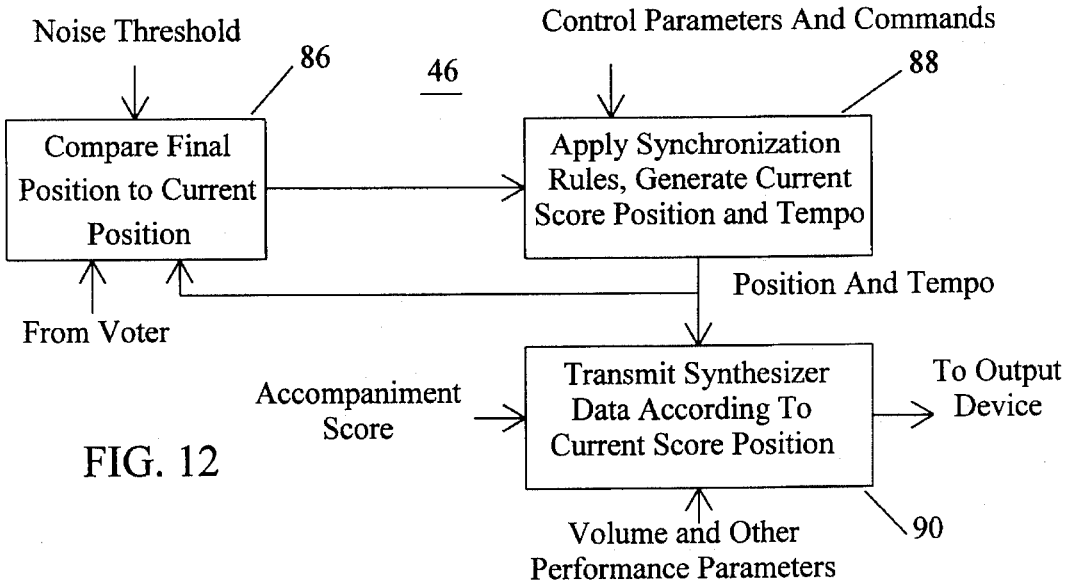
FIG. 12

AUTOMATED MUSICAL ACCOMPANIMENT WITH MULTIPLE INPUT SENSORS

BACKGROUND OF THE INVENTION

1. Field of the Invention

The present invention relates to a method and apparatus for providing automated, coordinated accompaniment with respect to a performance and, more specifically, automated, coordinated accompaniment for a performance by an ensemble.

2. Description of the Invention Background

Several systems for following and accompanying solo performers have previously been developed and described in the computer music literature. If all performers were perfect, then coordinating and synchronizing an automated accompaniment with an ensemble would be no more difficult than coordinating and synchronizing an automated accompaniment with a polyphonic instrument such as a piano. In reality, ensemble players are not necessarily very well synchronized, and some players may become lost or consistently drag or rush the tempo. Even when a performance goes well, individual players will rest and rejoin the ensemble as indicated in the score. During contrapuntally active sections of a composition, some performers may play moving lines while others sustain tones. An ensemble player must integrate that information and resolve contradictions to form a sense of the true ensemble tempo and score position.

The problem of solo accompaniment can be partitioned into three distinct sub-problems:

1. reliably detecting what the soloist has performed,
2. determining the score position of the soloist from the detected performance, and
3. producing an accompaniment in synchrony with the detected performance.

Likewise, a system which attempts to responsively accompany an ensemble of live performers must also address each of those tasks. Furthermore, the system's capabilities must be extended beyond those of the solo accompaniment system so that it is able to track multiple performers simultaneously. That corresponds to the multiple, simultaneous execution of reliable performance detection and determination of score position. Before taking actions to control production of the accompaniment, the system must also integrate the information derived from tracking each performer. That may require resolution of discrepancies, such as different estimates of the individual performer's score positions. In addition to problems encountered in tracking multiple performers and resolving discrepancies, problems are also encountered in reliably detecting what has been performed by the ensemble.

In dealing with the first of the three subproblems, i.e. reliably detecting what has been performed, the goal is to extract from the performance important musical parameters that can be used to determine the score position and tempo of each member of the ensemble. Such parameters might include fundamental pitch, note duration, attack, dynamic (relative loudness), and articulation. The precise parameters obtained by a particular system could vary according to the type of performance it tracks, how that performance is represented, and the expense and reliability with which certain parameters may be extracted from the representation. In the simplest case, MIDI messages sent from an electronic keyboard can provide very reliable, clean, and precise information about the pitch, duration, and dynamic of the performance. That information can be inexpensively extracted from such a representation.

In a more difficult case, the representation of the performance might be an audio signal from a microphone. That is often the case when tracking the performance from acoustic wind instruments. A system which must extract parameters from a representation like this will need to devote more computational time to analysis of the signal and deal with issues like background noise, and distinguish between signals received from onset transients versus sustained pitches. A yet more difficult case is to distinguish multiple instruments recorded with a single microphone. For performances from different instruments, the system may need to track different parameters. Tracking vocal performances presents its own unique set of problems.

The second task of an accompaniment system is tracking the score position of performers in real-time. That involves matching sequences of detected performance parameters to a score. The "score" might exist in a variety of forms, including a completely composed piece or simply an expected harmonic progression. Several considerations complicate tracking score location of multiple performers. First, the tracking needs to be accomplished efficiently so that the system is able to control the accompaniment in real-time. The more quickly a system can recognize that a soloist has entered early, for example, the more quickly it will be able to adjust the accompaniment performance to accommodate. Additionally, since a flawless performance is not guaranteed, the tracking process must be tolerant of extraneous parameters as generated by an occasional wrong note, extra note, or omitted note. Finally, the method chosen to track the performer must use, in an appropriate manner, the parameters extracted by the performance analyzer. For example, if the performance analyzer can reliably recognize pitch signals and extract the fundamental, but is not so reliable at recognizing attacks, the tracking system should be appropriately less dependent upon the attack information.

If successive score locations can be accurately identified in the performance and time-stamped, then the accompaniment system may be able to derive accurate tempo predictions. However, it is well-known that performers alter durations of notes for expressive purposes. Accompaniment systems must recognize such artistic variations so as to avoid sudden drastic tempo changes while at the same time remaining capable of reacting to actual, expressive tempo changes initiated by the performers. Reacting too slowly or too hesitantly to such legitimate changes can noticeably detract from the overall performance.

Once estimates of individual performers' score locations and tempi are obtained, an ensemble accompaniment system must combine and resolve that information. Before the system can make adjustments to the accompaniment performance, attempting to synchronize with the ensemble, it must have an idea of the overall ensemble score position and tempo. Several considerations affect generation of those estimates such as the reliability with which a performance is tracked. That would be the case if a performer's input signal is noisy and difficult to analyze, or for performers who make numerous mistakes (wrong notes, omitted notes, etc.) such that their score position cannot reliably be determined. A second consideration is the activity of the performer. A performer sustaining a long note may not provide as much information about score position as does a performer whose output is continually changing. Finally, the accompaniment system must be able to handle performers who are presumably lost, possibly having fallen behind or made an entrance too early.

Having obtained estimates of ensemble score position and tempo which take into account those considerations as much as possible, an accompaniment system must than decide when and how to adjust the accompaniment performance. Generally, an accompaniment must be continuous and aesthetically acceptable, yet reactive to the performers' omissions, errors, and tempo changes. If the performers increase or decrease the tempo for interpretive reasons, the accompaniment system should do likewise. If the performers pause or jump ahead in the score, then the accompaniment should follow as much as possible, but should always sound "musical" rather than "mechanical". The system must react to the performers' actions in a generally expected and reasonable fashion.

Thus, the need exists for reliably detecting what has been performed by an ensemble during a live performance and for coordinating and synchronizing an automated accompaniment therewith.

SUMMARY OF THE PRESENT INVENTION

The present invention is directed to an apparatus and method for automating accompaniment to an ensemble's performance. The apparatus is comprised of a plurality of input devices with each input device producing an input signal containing information related to an ensemble's performance. A plurality of tracking devices is provided, with each tracking device being responsive to one of the input signals. Each tracking device produces a position signal indicative of a score position when a match is found between the input signal and the score, and a tempo estimate based on the times when matches are found. A first voting device is responsive to each of the position signals for weighting each of the position signals. The weighting may be based on, for example, the frequency with which the position signal changes and the proximity of each position signal's score position to each of the other position signals' score position. The same weighting factors are then applied to the tempo estimate associated with that position signal. After the position signals and tempo estimates have been weighted, the voter device calculates a final ensemble score position signal in response to the weighted position signals and a final ensemble tempo based on the weighted tempo estimates. A scheduler is responsive to the final score position and final ensemble tempo for outputting an accompaniment corresponding thereto.

The voter device may weight each of the position signals according to the frequency with which it changes by assigning a recency rating to each of the position signals, wherein the recency rating decays from a value of one to zero over a period of time in which the value of the position signal is not updated in response to a match between the input signal and the score. The voter device may also weight each of the position signals according to the proximity of its score position to each of the other score positions by assigning a cluster rating to each of the position signals, wherein the cluster rating assumes a value on a scale of one to zero depending upon the proximity of each position signal's score position to all of the other position signals' score positions. In that manner, discrepancies are resolved by giving more weight to active performers whose score positions closely match the score positions of other active performers.

According to one embodiment of the present invention wherein a single performer, such as a vocalist, has several input devices responsive thereto, each producing an input signal, an additional voter device is provided which is responsive to each of the tracking devices receiving input signals from input devices responsive to the vocalist. The additional voter device produces a single position signal in response to the plurality of input signals produced by the vocalist. In that manner, the structure of the system enables a single position signal to be input to the first voter device such that any discrepancies between multiple input devices responsive to a single performer are resolved, and a single performer does not unduly influence the final score position merely because that performer had more than one input device responsive thereto.

The present invention provides a method and apparatus for reliably detecting what has been performed by the members of an ensemble, reliably determining score position, and for producing a coordinated, synchronized accompaniment according to the determined score position. The tempo of the live performance is accurately determined so that changes in tempo are compensated thereby assuring that the accompaniment remains in synchronization with the live performers. Discrepancies among performers are dealt with according to that performer's degree of activity and score position as compared to the score positions of the other performers. The present invention provides a dynamic and accurate accompaniment to an ensemble. Those and other advantages and benefits of the present invention will become apparent from the Description Of A Preferred Embodiment hereinbelow.

BRIEF DESCRIPTION OF THE DRAWINGS

For the present invention to be readily understood and practiced, preferred embodiments will be described in conjunction with the following figures wherein:

FIGS. 5–8 are block diagrams illustrating various types of voice tracking systems;

FIG. 9 illustrates a hidden Markov Model for matching lyrics;

FIG. 10 is a graph illustrating how score position may be estimated;

FIG. 11 is an excerpt from a score;

FIG. 12 is a block diagram illustrating the scheduler; and

DESCRIPTION OF A PREFERRED EMBODIMENT

Figure 1:
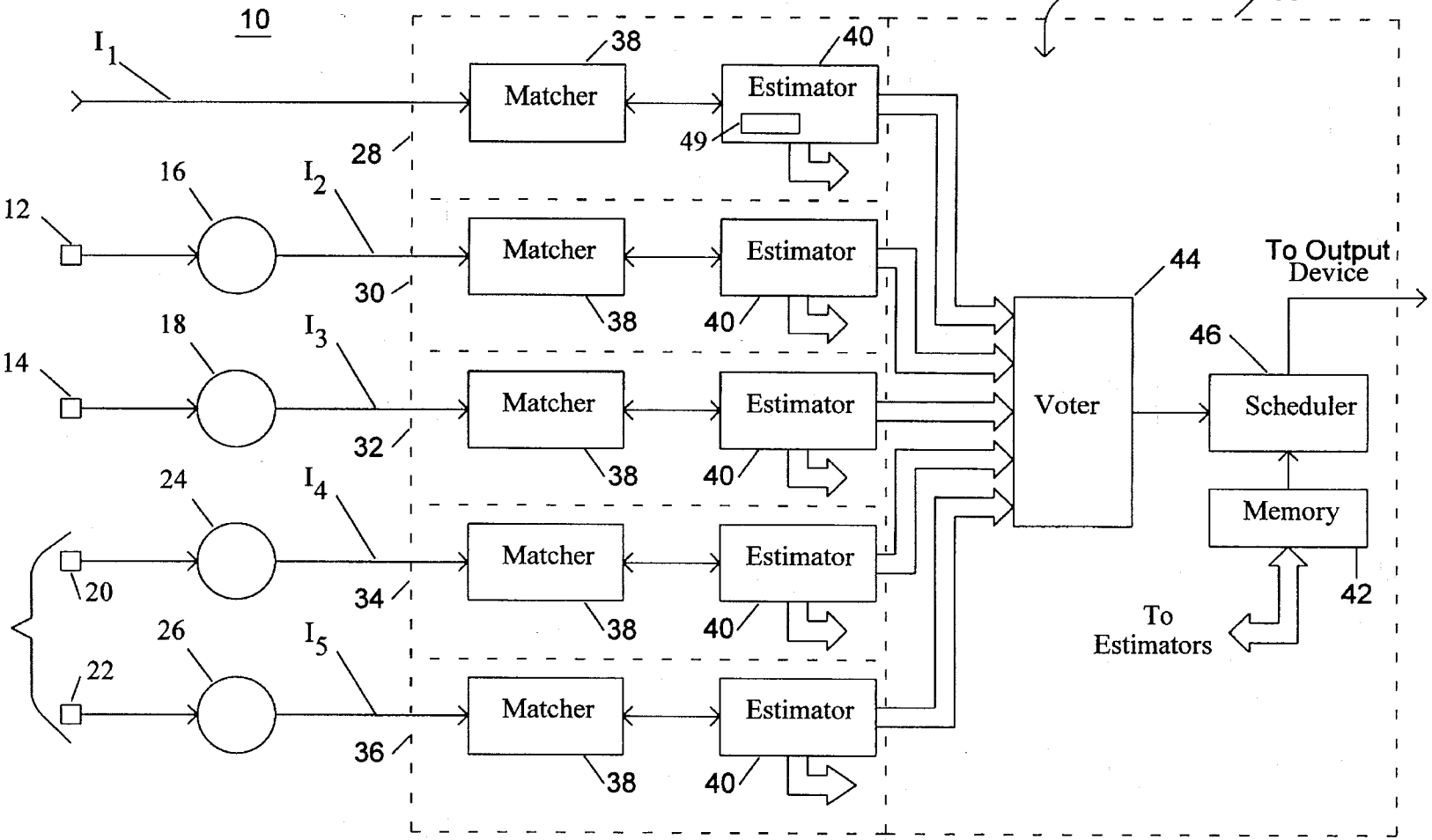
FIG. 1 is a block diagram illustrating an apparatus constructed according to the teachings of the present invention for providing automated accompaniment to an ensemble's performance.

FIG. 1 is a block diagram illustrating an apparatus 10 constructed according to the teachings of the present invention for providing an automated accompaniment to an ensemble's performance. As used herein, the term "ensemble" means an entity which generates two or more input signals. "Accompaniment" means not only a traditional musical accompaniment, but also other types of sound output, lighting or other visual effects such as computer animations, narrations, etc. Accompaniment is also intended to include other types of output such as automatically turning pages, scrolling electronic displays of music, providing feedback to performers who are not synchronized, and the like.

The apparatus 10 extracts musical parameters from an ensemble's performance, which musical parameters are represented by a sequence of MIDI messages. It makes use of pitch information provided in such messages as well as their arrival time. For electronic instruments, such as MIDI keyboards (not shown), this information, represented by the input signal $I_1$, can be easily and reliably obtained directly from the instrument. For acoustical wind instruments, microphones 12 and 14 are used. The output of microphones 12 and 14 is input to pitch-to-MIDI converters 16 and 18, respectively. The IVL Pitchrider 4000, pitch-to-MIDI converter may be used for converters 16 and 18 to transform the outputs of microphones 12 and 14 into MIDI message streams $I_2$ and $I_3$, respectively. Two other microphones 20 and 22 are similarly provided, each of which is connected to a pitch-to-MIDI converter 24, 26, respectively. The microphones 20 and 22 and pitch-to-MIDI converters 24 and 26 perform the same function as microphones 12 and 14 and pitch-to-MIDI converters 16 and 18 except that while microphones 12 and 14 are each responsive to separate performers, microphones 20 and 22 are responsive to the same performer. For example, these might be pickups on separate strings of an instrument. Pitch-to-MIDI converters 24 and 26 produce MIDI message streams $I_4$ and $I_5$, respectively. In that manner, a plurality of input signals is produced with each input signal containing some information related to the ensemble's performance. The reader should understand that the present invention is not limited in the number of input devices which may be employed. Generally, the number of input devices may be generalized as "n" with the input signal produced by the $n^{th}$ input device being $I_n$.

Note that the input devices need not be microphones, e.g., keys of a woodwind instrument can be sensed and used to derive pitches. Nor is it necessary to determine pitch, e.g., a drum set with a sensor on each drum could produce a suitable input signal for comparison to a score. Finally, MIDI is not essential, e.g., a speech recognition system would probably not encode its output into MIDI. Furthermore, other input sources may be used including switches, pressure transducers, strain gauges, position sensors, and microphone arrays. A single sensor, such as a microphone or microphone array, may provide a signal that, through processing, may be separated into multiple inputs corresponding to individual performers. Those multiple inputs may be substituted for the signals, $I_1$, $I_2$, $I_3$, $I_4$, $I_5$ from individual microphones.

Figure 2:
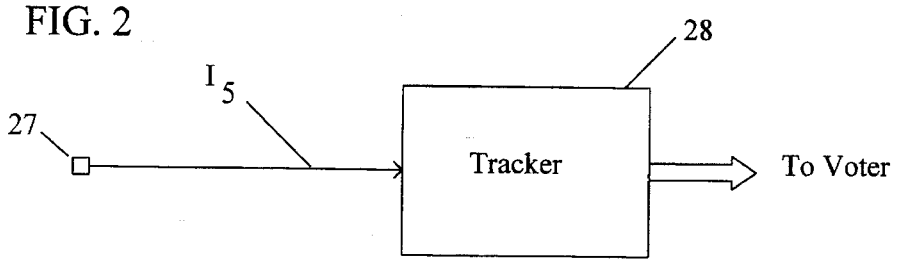
FIGS. 2 and 3 illustrate other input signal configurations.

If pushbutton switches are used to generate input signals, the type of information supplied by the input signals $I_1$, $I_2$, etc., can be easily obtained. For example, a vocalist might hold a wireless transmitting device 27, see FIG. 2, where a squeeze of the thumb transmits a signal $I_6$ to a tracker 28. The score would be annotated to enable the tracker 28 to match the received signal to the score.

Figure 3:
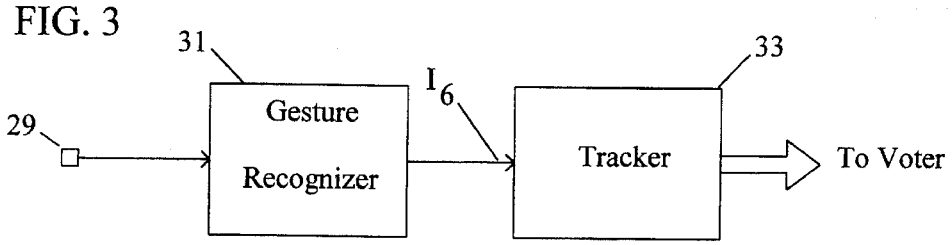

Conducting gestures are an example of non-audio input. In that case, a position sensor 29, shown in FIG. 3, sends a signal $I_7$ to a conducting gesture recognizer 31, and beat times and positions are reported to a tracker 33.

Returning to FIG. 1, each of the input signals $I_1$, $I_2$ , $I_3$, $I_4$, and $I_5$ is input to a tracking device 28, 30, 32, 34, and 36, respectively. Each tracking device is comprised of a matcher 38 and an estimator 40. Each tracking device 28, 30, 32, 34, and 36 produces a position signal indicative of a score position when a match is found between the input signal and a score, as more fully described below. Each tracking device 28, 30, 32, 34, and 36 is constructed and operates the same as all of the other tracking devices, assuming that the input signals $I_1$, $I_2$, $I_3$, $I_4$, and $I_5$ contain the same information. Tracking devices responsive to other types of input signals, e.g., $I_6$ and $I_7$, are appropriately modified so that they are capable of extracting the necessary information from their respective input signals.

To track the score position of individual performers, the tracker 28 uses a dynamic programming algorithm to match the parameters extracted from the performance against the score. The score is stored in memory 42. In practice, a prefix of the performance (some or all of what has been played up to present) is matched against a complete sequence found in the score. The basic algorithm works exclusively with the pitches of the recognized notes. The objective of the algorithm is to find the "best" match between performance and score according to the evaluation function:

$$evaluation = a \times matched\ notes - b \times omissions - c \times extra\ notes$$

The matching algorithm is applied on every recognized note in a given individual's performance. Although the number of ways the performed pitches can be matched against the score is exponential in the number of performed notes, dynamic programming allows us to compute the best match in time that is linear in the length of the score, and which gives a result after each performed note. By using a "window" centered around the expected score location, the work performed per note is further reduced to a constant. A more detailed presentation of the matcher's algorithm can be found in a paper entitled *Real Time Computer Accompaniment Of Keyboard Performances, Proceedings of the* 1985 *International Computer Music Conference,* 279–90, Bloch and Dannenberg, 1985, hereby incorporated by reference, which also shows how to modify the algorithm to handle polyphonic performance input (e.g., chord sequences played on a keyboard).

For vocal input, we have developed a software preprocessor that uses heuristic statistical techniques to clean up the attack and pitch information provided by the pitch-to-MIDI device described above. Alternatively, attack information can be provided by rectifying and filtering the input (envelope following) and detecting rapid rises in the envelope. Pitch information can be obtained by a number of techniques such as autocorrelation, time-domain peak detection, Fourier transform, or cepstrum analysis. See *Speech Recognition By Machine,* W. A. Ainsworth, IEE, 1988.

Figure 4:
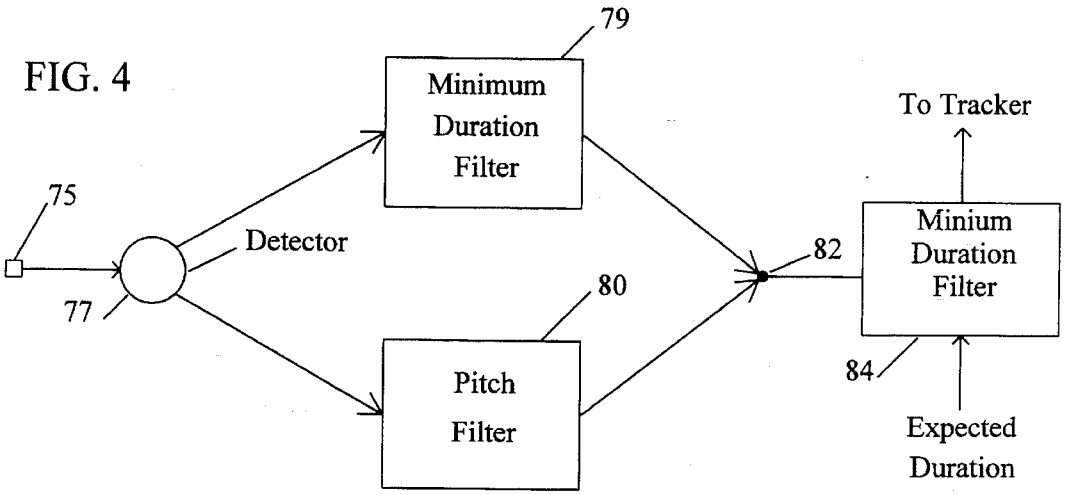
FIG. 4 is a block diagram illustrating one approach to handling vocal input.

Our approach using the software preprocessor for handling vocal input is illustrated in FIG. 4. In FIG. 4, a microphone 75 provides input to a simple pitch and attack detector 77. Attacks and pitch estimates are reported to minimum duration filter 79 where an attack initiates the averaging of successive pitch estimates. The average is output and merged at point 82. The minimum duration filter 79 inhibits output for a fixed duration after an output to enforce a minimum inter-attack time.

Pitch estimates are input to a steady pitch filter 80, which averages recent pitches. When some number of successive averages fall within the pitch range of one semitone and the semitone is not the same one previously output, the new semitone is output to the merge point 82. Output from the minimum duration filter 79 and steady pitch filter 80 are combined at the merge point 82. The combined signal may optionally be passed through a second minimum duration filter 84 which is adjusted to enforce a minimum duration which is some fraction of the expected duration. The expected duration is determined when a note reported to the matcher matches a note in the score. The duration of the matched note in the score is the duration expectation.

Figure 5:
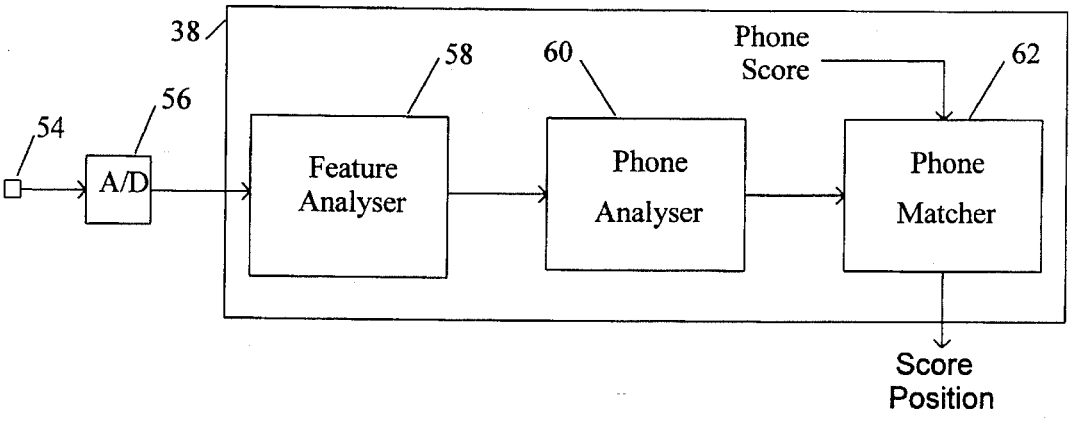

Another approach is for the matcher 38 to implement any of a wide variety of speech recognition techniques. Such techniques track a vocalist by using the lyrics as a key to the singer's position in the song. For each word in the lyrics, a dictionary provides a pronunciation as a sequence of speech sound units called phones. The sequences of phones from the dictionary are concatenated to form a phonetic pronunciation of the entire lyrics. Each phone is associated with a score position. To follow the score, dynamic programming is used as described in Bloch and Dannenberg, supra, except that instead of pitch sequences, phone sequences are used. In performing the dynamic programming algorithm, a match occurs when the input phone matches the phone derived from the lyrics. FIG. 5 illustrates that approach.

In FIG. 5, a microphone 54, responsive to a vocalist, provides an input signal to an analog-to-digital converter 56 which produces a digitized version of the analog input signal. The digitized signal is analyzed by feature analyzer 58 to extract a set of features called the feature vector. For example, one technique, used in the Sphinx speech recognition system at Carnegie Mellon University, computes cepstrum coefficients from a short segment of speech. For information about the Sphinx speech recognition system, see *Large Vocabulary Speaker-Independent Continuous Speech Recognition: The SPHINX System,* Kai-Fu Lee, Carnegie Mellon University Computer Science Report CMU-CS-88-148 (Ph.D. Thesis), 1988. As the speech recognition literature shows, other features are possible. See *Speech Recognition By Machine,* W. A. Ainsworth, IEE, 1988. Typically, feature vectors are computed from overlapping frames of input samples at regular time intervals of 10 to 20 ms. The feature vectors serve as input to the phone analyzer 60.

The Phone Analyzer 60 groups frames together into sound units called phones. For example, the aforementioned Sphinx speech recognition system uses Vector Quantization to reduce the cepstral coefficients from the feature analyzer 58 to an 8-bit code word. The 8-bits are simply an index in a "codebook" having 256 prototypes of cepstrum coefficients. A hidden Markov model is then used to find a sequence of phones that best accounts for the sequence of code words. The speech recognition literature shows other techniques for analyzing phones from a sequence of feature vectors.

The selected phones are sent to the phone matcher 62, where they are compared with the phone score, which is derived from the lyrics. In cases where there might be more than one pronunciation, an individual phone may be replaced by a set of alternative phones. A match is said to occur when the input phone matches any member of the set of candidate phones derived from the lyrics. Similarly, if the phone analysis results in several possible phones for a given segment of input, a match is said to occur when any one of the possible input phones matches a candidate phone in the score. For example, if the set of phones in the score is [/ae/,/aa/] and the phone analyzer 60 reports {/ih/,/eh/,/ae/}, then there is a match because /ae/ is a member of both sets. When a match is detected the score position of the matched phone is output.

Rather than phones, the units of analysis may be multiphoneme units such as demisyllables, diphones, syllables, triphones, or words.

A variant of phone matching is matching at the level of feature vectors. See FIG. 6. The feature vector of a frame of input sound is matched by feature matcher 64 to a score consisting of feature vectors which are derived from the lyrics. The features may be quantized using vector quantization or some other classification technique. The feature vector score must contain feature vectors at the analysis frame rate. For example, if a frame is analyzed every 10 ms, and the score indicates a steady sound is held for 500 ms, then there will be a sequence of 50 identical feature vectors in the score ready to match a similar sequence in the input.

For example, suppose the feature analyzer 58 classifies a frame every 20 ms as a fricative, plosive, dipthong, front vowel, middle vowel, back vowel, or silence. The score lyrics would be examined at 20 ms intervals (assuming a performance at the indicated tempo) to obtain an expected classification. During the performance, the features are compared to the score using the dynamic programming technique of the aforementioned Bloch and Dannenberg publication. Matches are reported.

An alternative to following the lyrics at the level of phonetic sounds is to use a real-time continuous speech recognition system as shown in FIG. 7. The lyrics are input into a speech recognizer 66, which outputs a sequence of words. The performed word sequence is matched by word matcher 68 to the lyrics using dynamic programming as described in the aforementioned publication, except that a match occurs when the words are identical or when one word is a homonym of the other, or where the words have a pre-determined similarity in pronunciation.

Current speech recognition systems sometimes use formal grammar and pronunciation tables to guide a comparison between a spoken utterance and a set of possible recognizable utterances. Typically, grammars consist of hundreds or thousands of words and a large number of alternative sentence structures. However, almost any speech recognition system that uses a specified grammar and vocabulary can be adapted to recognizing lyrics by specifying a grammar based on the song lyrics, see FIG. 8, because the vocabulary will be limited to cover only the words in the lyrics. As the match proceeds within the speech recognition system, intermediate match states are used to determine the current location within the lyrics.

For example, the aforementioned Carnegie Mellon University Sphinx system could be utilized for that application by providing a hidden Markov model based on the lyrics. The model would consist of a sequence of word subgraphs spliced end-to-end according to the lyrics. For example, if the lyrics are "Hello My Baby . . . ", then the hidden Markov model will appear as in FIG. 9. The model is expanded by replacing each word in the word sequence by a phone model, and by replacing each phone with a feature model. This fully expanded model is searched for the best sequence of states (the sequence of states in the hidden Markov model that is most likely to produce the observed output) as the input sound is analyzed.

After quantization at block 70, various search methods are possible as described in the speech literature. A Viterbi search is possible with small models. For larger models, a beam search has been found to work well. Other techniques include level building and stack decoding. All of those techniques can construct matches to the partial input as it becomes available in the course of a vocal performance. The best match up to the current time is output as an estimate of the score location. A confidence level for that location estimate can be based on whether the location estimate is increasing steadily in time, the difference in likelihood between the best location estimate and the nearest contender (a wide gap leads to greater confidence) and the degree of match. The confidence measure is used to determine when to update the position estimate parameters. It can also be used as a weighting factor when this position estimate is combined with position estimates from other sensors.

While the present invention has been described in terms of position signals being derived from pitch information and lyrical information, other parameters of the performance, such as note-onset timing, sequences of chords, sequences of octaves, or the like, may be used to detect score position and performance tempo.

Returning to FIG. 1, a position signal representative of a score position is posited by the matcher for each input signal (or performer) on every received input note. Each score position is recorded in a buffer 49 along with a timestamp indicating the real time when that location was reached. In the estimator 40, successive score positions for a given input signal may be plotted versus the corresponding real time. The tempo of the performance at any point is given by the slope of the graph because tempo is the amount of score traversed in a unit of real time. As previously mentioned, it is necessary to apply some form of averaging over the individual tempi found at successive points in the graph. While many averaging techniques are available, we have elected to simply take the slope of the line between the first and last points in the location buffer. Because the buffer's 49 size is limited and relatively small, with older entries discarded one at a time once the buffer's capacity is exceeded, that tempo estimation is responsive to actual changes in tempo but less "jerky" than estimates based solely on the two most recent buffer entries. That method of averaging is also more expedient than calculating the true mean tempo or applying linear regression. In practice, it has worked well. If the tracker 28 detects an error or leap in the input signal's score position (i.e., the matcher cannot conclusively identify a score position for the performer), the buffer is emptied and no tempo estimates for that performer are possible until the buffer is replenished.

Because the ensemble accompaniment system 10 must track multiple performers simultaneously, separate instances of a match state and score location buffer are maintained. Because score location information for each performer is available, it is possible to estimate each performer's current score location at any time, providing the matcher 38 has been able to follow that performer. For example, consider FIG. 10. If at time $t_1$ the performer is at score location $s_1$ and maintaining an estimated tempo of 0.5; then at time $t_1+2$ the performer's expected score location would be $s_1+1$ (if no intervening input is received from the performer). That enables the estimator 40 to estimate score positions for every ensemble member for the same point in time, regardless of when the system last received input from that performer. That estimated score position may be used to generate the window centered therearound, which window is input to the matcher 38. Alternatively, the estimated ensemble score position from the voter 44 may be used to generate the windows centered therearound, which windows are input to the matchers 38. That will help prevent the matcher from losing track of the performer.

Each tracker 28 provides a pair of estimates which is input to a voter 44. The pair of estimates include the position signal produced by the matcher 38 which is indicative of a score position when a match is found between the input signal and the score, and a tempo estimate produced by the estimator 40. The various position signals and tempo estimates obtained from each tracker 28 must be consolidated into a single ensemble score position and tempo. The accompaniment apparatus 10 estimates an ensemble score position and tempo on every input on every performer. To accomplish that in a manner which resolves discrepancies, each pair of estimates from each tracker 28 is weighted, and a weighted average computed from both position signals and tempo estimates. The ratings give more weight to estimates which are more recent and estimates of score positions which cluster with estimates of score positions from other trackers 28.

To determine which position signals and which tempo estimates are more recent, a recency rating (RR) for each tracking system 28 is provided. The recency rating is calculated according to the following equation:

$$RR(i) = 1 - \frac{(\text{rtime} - \text{ltime}(i))}{TC}$$

If rtime–ltime(i)≦TC

If rtime–ltime(i)>TC, then RR(i)=0, where:

rtime=Current time for which estimates are made ltime(i)=Time of last match made by tracker 28

TC=Time constant, typically 3 seconds

The recency rating for each tracker 28 decays from a value of one to zero during interval TC. If the score position buffer of the tracker 28 is empty, then the recency rating is zero. The recency rating is squared in the final rating product as described below, causing the final rating to decay more rapidly (in a quasi-exponential fashion) over the interval TC. The recency rating is designed to give preference to the most recently active performers, thereby making the accompaniment performance more reactive to recent changes in the score position and tempo.

The cluster rating (CR) characterizes the relative separation of the various score position estimates provided by each position signal and is given by the following equation:

$$CR(i) = 1 - \frac{\left(\sum_{j=1}^{n} |pos(i) - pos(j)|\right) + |acc - pos(i)|}{n \times (pos(\max) - pos(\min)) + eps}$$

n=Number of active trackers 28 pos(i)=Score position for tracker i pos(j)=Score position for tracker j acc=Accompaniment score position calculated by scheduler pos(max)=Maximum of all pos(i), pos(j), and acc pos(min)=Minimum of all pos(i), pos(j), and acc eps=a small number to avoid division by zero, typically 0.1 seconds The cluster rating is the ratio of the summed distance of the $i^{th}$ score position from the other score positions divided by the maximum possible summed distance at the time the rating is generated. It indicates, on a scale from zero to one, how close a particular performer's score position lies to the location of the other performer's (i.e., the rest of the live ensemble and the accompaniment). If all performers (including the accompaniment) are at the exact same score position, all will have a cluster rating of one. As the score positions of the performers start to vary, their cluster ratings will fall below one. If their relative distances from one another remain similar, their cluster ratings will also remain similar. If one performer's distances from the others are much larger relative to their distances from one another (i.e., all but one form a relatively tight cluster), then the cluster ratings of the "cluster" members will remain relatively similar while the rating of the other performer will be significantly lower. If the cluster members in this case all have the exact same score position, then the other performer's clustering rating will be nearly zero. The cluster rating is designed to discount information obtained from a performer whose score position is abnormally distant from the rest of the ensemble. Note that the current accompaniment position may be considered in calculating the cluster rating. That provides a slight bias toward performers who are currently synchronized with the accompaniment when the performers' ratings would otherwise be very similar. The cluster rating, like the recency rating, is squared in the final rating so as to give an even stronger preference to the tightly clustered performers.

Once the recency ratings and cluster ratings have been calculated, the final rating (FR) for each position signal and tempo estimate from each tracker 28 is calculated as follows:

$$FR(i)=(RR(i))^2\times(CR(i))^2+c$$

FR(i)=Final rating for position signal from $i^{th}$ tracker;

RR(i)=Recency rating for position signal from $i^{th}$ tracker;

CR(i)=Cluster rating for position signal from $i^{th}$ tracker;

c=Very small constant to prevent FR from reaching zero, typically 0.001

As is apparent, the final rating is the product of the squares of two independent ratings, the recency rating and the cluster rating, for the reasons previously mentioned.

While the present invention has been described in terms of a final rating being derived from a recency rating and a cluster rating, additional factors may be used; for example, a measure of confidence from each tracker may provide another factor resulting in a lower final rating if the tracker information is judged to be less reliable. The confidence level and other factors may depend upon the input source (some sources or performers may be known to be unreliable), upon the score (a performer may have difficulty in certain passages), or upon a specific performance (e.g. the matcher may detect the performer or sensor is not performing consistently, either recently or in the long term.)

The ensemble's score position is calculated as a weighted average of the trackers' estimates of score position according to the following equation:

$$\text{Ensemble Score position}=\frac{\sum_{i=1}^{n} FR(i)\times pos(i)}{\sum_{i=1}^{n} FR(i)}$$

Each tracker's final rating influences the ensemble score position according to its relative satisfaction of the previously discussed criteria, compared to the estimates from the other trackers. Each estimate is weighted by its final rating. The final rating is a product of the squares of the recency and cluster ratings and is guaranteed to be less than or equal to the minimum of the individual squares because the recency and cluster ratings range from zero to one. Thus, as the criteria characterized by the component ratings fail to be satisfied, the final rating for that performer decreases.

The same equation is used to determine the final ensemble tempo, except that the position term "pos(i)" is replaced be the tempo estimate from the $i^{th}$ tracker 28.

An example of how the final ensemble score position and tempo change over time may be seen by considering the score excerpt presented in FIG. 11. As the first performer proceeds, the recency rating of the other, sustained or resting voices, will decay. The tempo and score position estimated by the first performer's tracker 28 will quickly dominate the ensemble average, in turn causing the accompaniment to more closely follow the first performer.

Once the voter 44 has calculated the final ensemble score position and final ensemble tempo, that information is handed to a scheduler 46. (See FIG. 12.) The scheduler 46 receives at block 86 a noise threshold, the final ensemble score position and tempo from voter 44, and the current position and tempo information. The result of a comparison between the signals from voter 44 and the current position and tempo information, taking into account the noise threshold, is output to block 88. Block 88 applies a set of accompaniment rules to adjust the accompaniment performance. Those rules correspond to studies of how live accompanists react to similar situations encountered during a performance. See *Tempo Following Behavior in Musical Accompaniment,* Michael Mecca, Carnegie Mellon University Department of Philosophy (Master's Thesis), 1993. The rules consider the time difference between the ensemble score position and the current accompaniment score position. If the time difference is less than the pre-determined noise threshold, then only the accompaniment tempo is modified to agree with the ensemble tempo. The noise threshold prevents excessive jumping and tempo alterations, because performers do make subtle alterations in note placement. If the ensemble is ahead of the accompaniment by a difference at least as great as the noise threshold, the accompaniment will either jump to the ensemble score position or play at a fast tempo to catch up. The technique applied depends on the magnitude of the time difference. If the accompaniment is ahead of the ensemble by a time difference at least as great as the noise threshold, then the accompaniment will pause until the ensemble catches up. The position and tempo information are passed to block 90 which uses that, and other information, to generate the accompaniment which is output to an output device.

To prevent the accompaniment from continuing too far ahead of the performers, an input expectation point is maintained. If that point is passed without additional input from any performer, the accompaniment apparatus 10 pauses until additional input arrives.

The noise threshold may depend upon a confidence level reported by the voter. When confidence is high, the threshold is low so that the accompaniment will track closely. When the confidence is low, the threshold is high so that timing adjustments are avoided in the absence of reliable information. The confidence level may be based on final ratings from trackers, e.g., the maximum or sum of final ratings. Additional knowledge may also be incorporated into the confidence level, e.g., that some performers or sensors have less timing accuracy than others. The score may contain additional information in the form of annotations that alter scheduling rules and parameters depending upon score location. Furthermore, the scheduler may have direct controls indicating when to stop, start, ignore voter input, use voter input, play faster, play slower, play louder, or play softer. For example, a hand-held wireless transmitter could be used by a vocalist to modify the accompaniment performance by inputting commands directly to block 88. In rhythmic passages, the vocalist could disable the voter and follow the accompaniment, using a tempo controller to make small adjustments. Then, in expressive passages, the vocalist could enable the voter, causing the accompaniment to follow the lead of the vocalist.

Schedulers are known in the art such that further description here is not warranted. The reader desiring more information about schedulers may refer to *Practical Aspects of a Midi Conducting Program,* from *Proceedings of the* 1991 *International Computer Music Conference,* pp. 537–540, Computer Music Association, San Francisco.

That portion 48 enclosed by broken line 50 of the apparatus 10 shown in FIG. 1 may be implemented in software. In a software implementation, it may be convenient to merge input signals $I_1$, $I_2$, $I_3$, $I_4$, $I_5$ into a single MIDI connection, in which case the source of each MIDI message would be identified by its MIDI channel. The portion 48 has been implemented using the Carnegie Mellon University MIDI Toolkit which provides MIDI message handling, real-time scheduling, and performance of MIDI sequences. It is possible to adjust the position and tempo of a sequence (score) performance on-the-fly as part of processing input or generating output. The portion 48 consists of four software components, implemented in an object-oriented programming style. FIG. 1 diagrams the interconnection of the four software components. The matcher 38 receives performance input and uses dynamic programming to determine score location. The estimator 40 maintains the score location buffer, calculates tempi, and generates estimates on request. A matcher-estimator combination forms a single performance tracker 28. The portion 48 can instantiate multiple trackers 28 at initialization according to user-supplied specifications. The voter 44 rates and combines the multiple score location and tempo estimates to form the ensemble estimates. The scheduler 46 uses those estimates to change the accompaniment performance according to the accompaniment rules.

When implementing the present invention in software, computation time becomes a consideration, and is also important to the issue of scaling. Processing each input from each performer requires time linear in the ensemble size because the estimates from every tracker must be re-rated. In the worst case, if all parts simultaneously play a note, the amount of work completed before performance of the next note in the score is quadratic in the ensemble size. When running the present invention on the slowest PC we have available, handling a single input for an ensemble of one requires 1.4 msec. The expense of recomputing one rating (for larger ensembles) is 0.3 msec. Based on those numbers, a conservative estimate indicates that we can process 16 inputs in 100 msec. A sixteenth note of 100 msec. duration implies a tempo of 150 quarter notes per minute. That is a fast tempo. If we were to update the voter once every 100 msec. instead of on every input, we could handle hundreds of instruments in real time with current processor technology. For large acoustic ensembles, computation time is likely to be dominated by signal processing of acoustic input.

Figure 13:
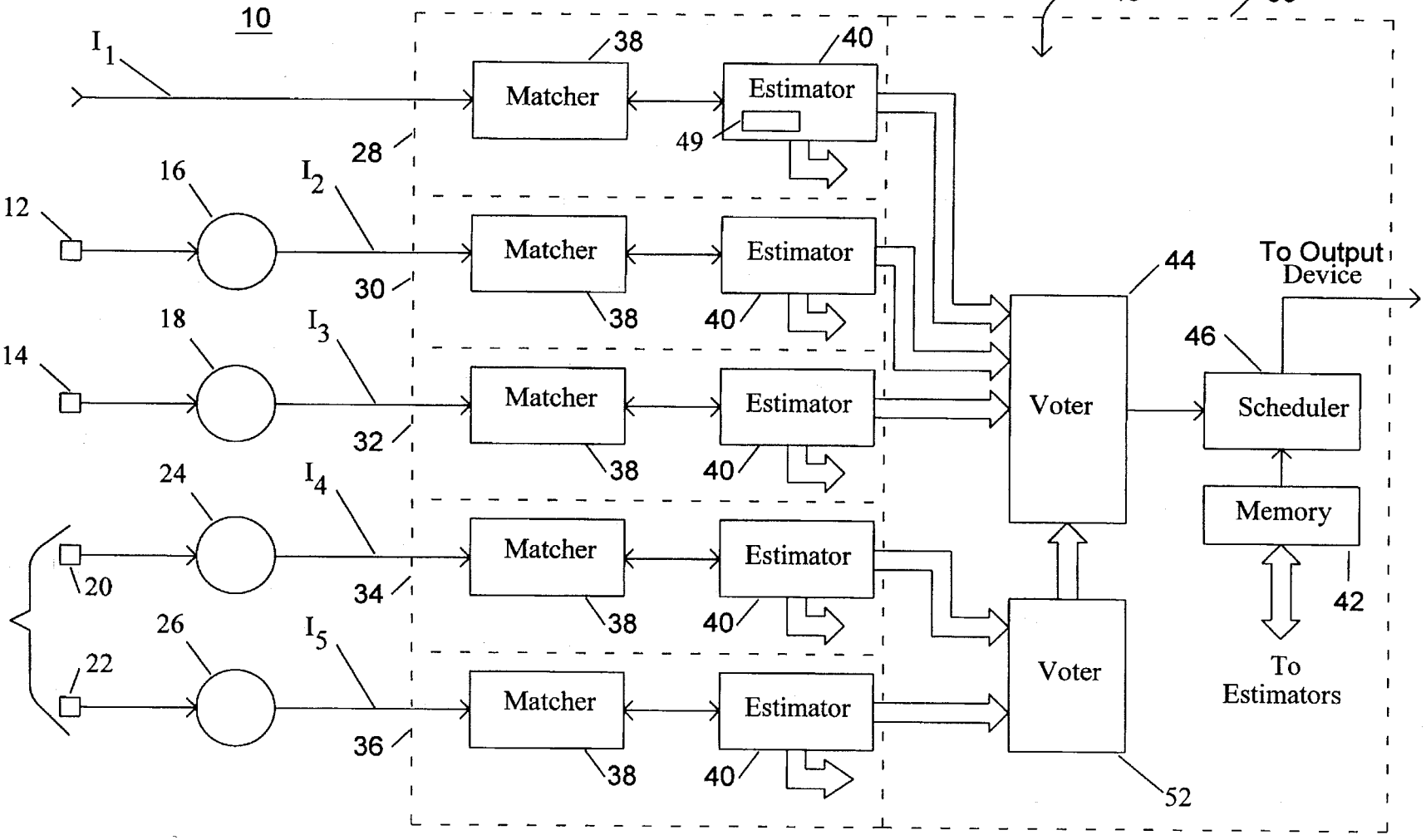
FIG. 13 is a block diagram of another embodiment of an apparatus for providing automated accompaniment to an ensemble's performance in accordance with the teachings of the present invention.

Another embodiment of the present invention is illustrated in FIG. 13. In FIG. 13, like components are given similar reference numbers as are used in FIG. 1. In FIG. 13, the apparatus 54 constructed according to the teachings of the present invention is substantially the same as the apparatus 10 shown in FIG. 1. However, because microphones 20 and 22 are responsive to the same performer, it is recognized that a single performer can only be at one score position at any given time, regardless of the signals being provided by microphones 20 and 22. For that reason, the output of estimator 40 and tracker 34 is input to a second voter 52 while the outputs of the estimator 40 and tracker 36 are also input to the second voter 52. The second voter 52 performs the same functions as those previously discussed in conjunction with voter 44. However, the output of voter 52 is a final score position for the performer being sensed by microphones 20 and 22. In that manner, a performer which has two or more microphones only has one signal representative of that performer's score position input to voter 44 rather than two or more as is the case with the system of FIG. 1. In that manner, the voter 44 is not unduly influenced by a plurality of position signals all representative of the same performer. That type of preprocessing could also be used with large ensembles which have more performers than the apparatus 10 or 54 is capable of handling. By using such preprocessors, the signal input to the voter 44 might be representative of position and tempo of the first trumpet section, for example, rather than each of the individual performers within the first trumpet section.

The present invention has been implemented and tested with small ensembles of electronic and acoustic instruments. The present invention provides a solution to each of the problems faced by a device for providing automated accompaniment: obtaining reliable performance input, tracking score position and tempo of individual performers, combining individual position and tempo of individual performers, combining individual position and tempo estimates to form an ensemble score position and tempo, and considering ensemble estimates when deciding how to generate an aesthetically acceptable performance of the system 10. When generating score location and tempo estimates for an ensemble, it is useful to consider both the recency of input from individual performers and the relative proximity (or "clustering") among their score positions. That information helps to distinguish the active and reliable performers from the inactive or lost ensemble members, whose predictions do not accurately indicate the score position and tempo of the ensemble.

While the present invention has many real time applications, some of which have been described above, other applications are contemplated which need not be carried out in real time. Such applications include analysis of ensemble tempo for instructional or research purposes or manipulation or transformation of recorded material, for example, to synchronize independently recorded parts.

Although the present invention has been described in conjunction with preferred embodiments thereof, it is expected that many modifications and variations will be developed. This disclosure and the following claims are intended to cover all such modifications and variations.

What is claimed is:

1. Apparatus for automating accompaniment to an ensemble performance, comprising:

a plurality of input means, each input means producing an input signal containing information related to an ensemble's performance;

storage means for storing information about a score;

a plurality of tracking means, each responsive to one of said input signals and said storage means, for producing a position signal indicative of a score position when a match is found between said input signal and said information about said score;

first voter means, responsive to each of said position signals, for weighting each of said position signals according to the frequency with which it changes and the proximity of its score position to each of the other score positions represented by each of the other position signals, said voter means for calculating a final ensemble score position signal in response to the weighted position signals; and scheduler means, responsive to said final ensemble score position signal, for outputting an accompaniment corresponding to said final ensemble score position signal.

2. The apparatus of claim 1 wherein said first voter means weights each of said position signals according to the frequency with which it changes by assigning a recency rating to each of said position signals and wherein said recency rating decays from a value of one to zero over time if the value of said position signal does not change over time.

3. The apparatus of claim 2 wherein said first voter means assigns a recency rating by determining 1−(rtime−ltime)/TC secs if rtime−ltime≦TC and assigning a value of zero if rtime−ltime>TC, where rtime is the current time for which estimates are made and ltime is the time of the last match found between said input signal and said score.

4. The apparatus of claim 1 wherein said first voter means weights each of said position signals according to the proximity of its score position to each of the other score positions by assigning a cluster rating to each of said position signals, and wherein said cluster rating assumes a value on a scale of one to zero depending upon the proximity of each position signal's score position to all of the other position signals' score positions.

5. The apparatus of claim 4 wherein said first voter means assigns a cluster rating by determining:

$$CR(i) = 1 - \frac{\left(\sum_{j=1}^{n} |pos(i) - pos(j)|\right)}{n \times (pos(\max) - pos(\min)) + eps}$$

n=Number of active trackers pos(i)=Score position for tracker i pos(j)=Score position for tracker j pos(max)=Maximum of all pos(i), pos(j)

pos(min)=Minimum of all pos(i), pos(j)

eps=small constant.

6. The apparatus of claim 1 wherein said first voter means weights each of said position signals according to the frequency with which it changes by assigning a recency rating to each of said position signals wherein said recency rating decays over time if the value of said position signal does not change over time, and wherein said first voter means weights each of said position signals according to the proximity of its score position to each of the other score positions by assigning a cluster rating to each of said position signals, and wherein said cluster rating assumes a value dependent upon the proximity of each position signal's score position to all of the other position signals' score positions, and wherein said first voter means calculates a final rating (FR) for each position signal based on said recency rating and said cluster rating, said final rating being use by said first voter means to calculate said final ensemble score position.

7. The apparatus of claim 6 wherein said voter means calculates a final rating by solving:

$$FR(i)=(RR(i))^2\times(CR(i))^2+c$$

where

FR(i)=Final rating for position signal from $i^{th}$ tracker

RR(i)=Recency rating for position signal from $i^{th}$ tracker

CR(i)=Cluster rating for position signal from $i^{th}$ tracker c=small constant.

8. The apparatus claim 6 wherein said final ensemble score position is calculated by solving:

$$\text{Final Ensemble Score Position} = \frac{\sum_{i=1}^{n} FR(i) \times pos(i)}{\sum_{i=1}^{n} FR(i)}.$$

9. The apparatus of claim 4 wherein said final ensemble score position signal is treated as a position signal for determining said cluster rating.

10. The apparatus of claim 9 wherein said first voter means assigns a cluster rating by determining:

$$CR(i) = 1 - \frac{\left(\sum_{j=1}^{n} |pos(i) - pos(j)|\right) + |acc - pos(i)|}{n \times (pos(\max) - pos(\min)) + eps}$$

n=Number of active trackers pos(i)=Score position for tracker i pos(j)=Score position for tracker j acc=Final ensemble score position pos(max)=Maximum of all pos(i), pos(j), and acc pos(min)=Minimum of all pos(i), pos(j), and acc eps=small constant.

11. The apparatus of claim 1 wherein each of said plurality of input means is responsive to a separate performer.

12. The apparatus of claim 1 wherein at least two of said plurality of input means are responsive to the same performer, and wherein said plurality of tracker means responsive to said at least two input means produces first and second position signals.

13. The apparatus of claim 12 additionally comprising second voter means, responsive to said first and second position signals, for weighting each of said position signals according to the frequency with which it changes and the proximity of its score position to the score position of the other position signal, said second voter means for calculating a final performer score position signal in response to the weighted first and second position signals, and wherein said final performer score position signal is input to said first voter means wherein it is treated as a position signal.

14. The apparatus of claim 1 wherein each said tracking means includes estimator means for determining the tempo associated with the input signal to which said tracking means is responsive and for establishing a window of possible score positions based on said tempo and a last score position, said tracking means further including matching means for comparing said input signal to said window of possible score positions for producing said position signal when a match is found.

15. The apparatus of claim 14 wherein each of said estimator means includes a location buffer for storing score positions and for storing a timestamp indication of the real time when each score position was reached, said estimator means further including averaging means for determining said tempo by determining the average slope of a curve that would result from a plot of score positions versus timestamp indications.

16. The apparatus of claim 1 wherein the ensemble is a single performer to which said plurality of input means are responsive.

17. The apparatus of claim 1 wherein the accompaniment is produced simultaneously with a performance.

18. The apparatus of claim 1 wherein said stored information about a score includes at least one type of information selected from the group comprising pitch, note-onset timings, cords, sequences of cords, sequences of pitch classes, phones, phonemes, words, sequences of words, and annotations.

19. The apparatus of claim 18 wherein said input signals include non-audible information such as gestures.

20. The apparatus of claim 18 wherein said input signals include non-audible information such as cues.

21. The apparatus of claim 18 wherein said scheduler means outputs said accompaniment according to scheduling rules.

22. The apparatus of claim 21 wherein said annotations are used to alter said scheduling rules.

23. The apparatus of claim 21 wherein said scheduling means is responsive to the input of instructions selected from the group comprising start, stop, ignore first voter means, follow first voter means, play faster, play slower, play louder, and play softer.

24. The apparatus of claim 1 wherein said plurality of input means includes at least one microphone array for producing an input signal.

25. The apparatus of claim 1 wherein said first voter means additionally weights each of said position signals according to its reliability.

26. The apparatus of claim 25 wherein reliability is based upon at least one type of information selected from the group comprising the performer's mistakes, sensor noise, sensor errors, the frequency with which the position signal changes, and the consistency of a match between the position signal's estimate of score position and the final ensemble score position.

27. Apparatus for automating accompaniment to a vocalist's performance, comprising:

first input means responsive to the pitch of the vocalist to produce a first input signal;

second input means responsive to some other parameter of the vocalist's performance to produce a second input signal;

storage means for storing information about a score;

first and second tracking means responsive to said first and second input signals, respectively, and to said storage means for producing first and second position signals indicative of a score position when a match is found between said first and second input signals, respectively, and said information about said score;

first voter means, responsive to each of said position signals, for weighting each of each said position signals according to the frequency with which it changes and the proximity of its score position to the score position represented by the other position signal, said voter means for calculating a final ensemble score position signal in response to the weighted position signals; and scheduler means, responsive to said final ensemble score position signal, for outputting an accompaniment corresponding to said final ensemble score position signal.

28. The apparatus of claim 27 wherein said first input means includes a microphone producing a signal for input to a pitch and attack detector means, minimum duration filter means responsive to said pitch and attack detector means and pitch filter means responsive to said pitch and attack detector means, an output of said minimum duration filter means and an output of said pitch filter means being merged to form a signal that is input to said first tracking means.

29. The apparatus of claim 28 additionally comprising a second minimum duration filter means for receiving said merged signal and comparing the duration of said merged signal to an expected duration to produce an output signal that is input to said first tracking means.

30. A method for automating accompaniment to an ensemble performance, comprising the steps of:

producing a plurality of input signals each containing information related to the ensemble's performance;

storing information about a score;

comparing said input signals to said stored information about the score;

producing a position signal indicative of a score position when a predetermined relationship exists between said input signal and said information about said score;

weighting each of each said position signals according to the frequency with which it changes and the proximity of its score position to each of the other score positions represented by each of the other position signals;

calculating a final ensemble score position signal in response to the weighted position signals; and outputting an accompaniment according to a set of rules in response to said final ensemble score position signal.

* * * * *